US005730295A

United States Patent [19]

Darby

[11] Patent Number: 5,730,295

[45] **Date of Patent: *Mar. 24, 1998**

[54] PALLET SYSTEM INCLUDING END PANELS

[75] Inventor: Robert J. Darby, Greensboro, N.C.

[73] Assignee: T.H.E.M. International, Inc., Greensboro, N.C.

[ * ] Notice: The term of this patent shall not extend beyond the expiration date of Pat. No. 5,531,327.

[21] Appl. No.: 670,030

[22] Filed: Jun. 25, 1996

Related U.S. Application Data

[63] Continuation-in-part of Ser. No. 333,436, Nov. 2, 1994, Pat. No. 5,531,327.

[51] Int. Cl.[6] ..... B65D 19/02; B65D 71/10; B65B 53/00

[52] U.S. Cl. ..... 206/600; 53/441; 108/53.5; 108/55.3; 108/56.3; 206/394; 206/497; 206/597

[58] Field of Search ..... 108/53.1, 53.5, 108/55.1, 55.5, 56.1, 56.3; 206/386, 392, 394, 497, 597, 600, 599; 53/441, 442

[56] References Cited

U.S. PATENT DOCUMENTS

| | | | |
|---|---|---|---|
| 2,893,588 | 7/1959 | Martin . | |
| 3,664,570 | 5/1972 | Kupersmit . | |
| 3,799,382 | 3/1974 | Munroe . | |
| 3,930,579 | 1/1976 | Kurtz . | |
| 3,949,929 | 4/1976 | Kupersmit . | |
| 3,968,895 | 7/1976 | Barnes, Jr. et al. . | |
| 4,098,400 | 7/1978 | Brown . | |
| 4,413,737 | 11/1983 | Wird | 206/600 X |
| 4,550,830 | 11/1985 | Shuert | 206/386 |
| 4,580,680 | 4/1986 | Wind . | |
| 4,667,823 | 5/1987 | Wolfe, Jr. et al. . | |
| 4,742,781 | 5/1988 | Shuert | 108/53.3 |
| 4,756,138 | 7/1988 | Karpisek . | |
| 4,765,252 | 8/1988 | Shuert | 108/55.1 |
| 4,809,851 | 3/1989 | Oestreich, Jr. et al. | 206/599 |
| 4,811,840 | 3/1989 | Muyskens | 206/497 X |
| 4,856,657 | 8/1989 | Shuert | 206/600 |
| 4,877,137 | 10/1989 | Govang et al. | 206/597 |
| 4,919,270 | 4/1990 | Govang et al. . | |
| 4,936,951 | 6/1990 | Shuert | 206/386 |
| 4,944,404 | 7/1990 | Mead . | |
| 4,998,619 | 3/1991 | Sowa et al. . | |
| 5,056,666 | 10/1991 | Janssens . | |
| 5,056,667 | 10/1991 | Coogan . | |
| 5,323,896 | 6/1994 | Jones | 206/223 |
| 5,390,789 | 2/1995 | Darby . | |
| 5,531,327 | 7/1996 | Darby | 206/600 |

FOREIGN PATENT DOCUMENTS

| | | | |
|---|---|---|---|
| 0 465 815 A3 | 1/1992 | European Pat. Off. . | |
| 2412466 | 8/1979 | France . | |
| 2643043 | 8/1990 | France . | |
| 0008392 | 1/1977 | Japan | 53/441 |

*Primary Examiner*—Bryon P. Gehman
*Attorney, Agent, or Firm*—Rhodes, Coats & Bennett, L.L.P.

[57] ABSTRACT

A shrink wrap or stretch wrap pallet system including a pair of end panels arranged and configured so as to mount on opposite sides of a package, effectively connecting a base pallet and a top panel. The end panels themselves are spaced from the perimeter of the package. The end panels have vertical edges which extend beyond the perimeter of the package, thereby defining a plane between respective end panels, the plane serving to space the wrap, which lies substantially therein, from the package. The end panels are conveniently sized and shaped to fit within the area of the base pallet, intermediate panels and top panel thereby providing a relatively compact return package. Side panels may be provided to supplement the end panels.

7 Claims, 11 Drawing Sheets

FIG. 4A
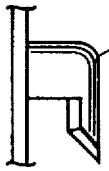
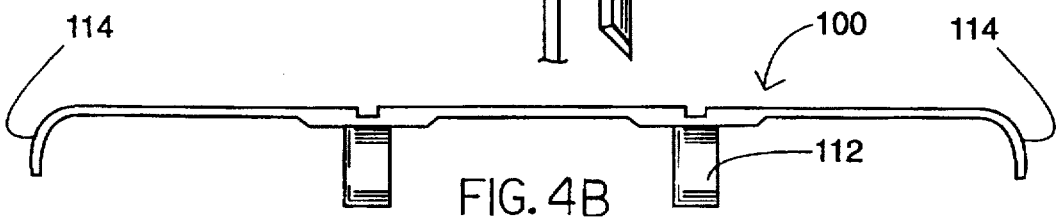
FIG. 4B
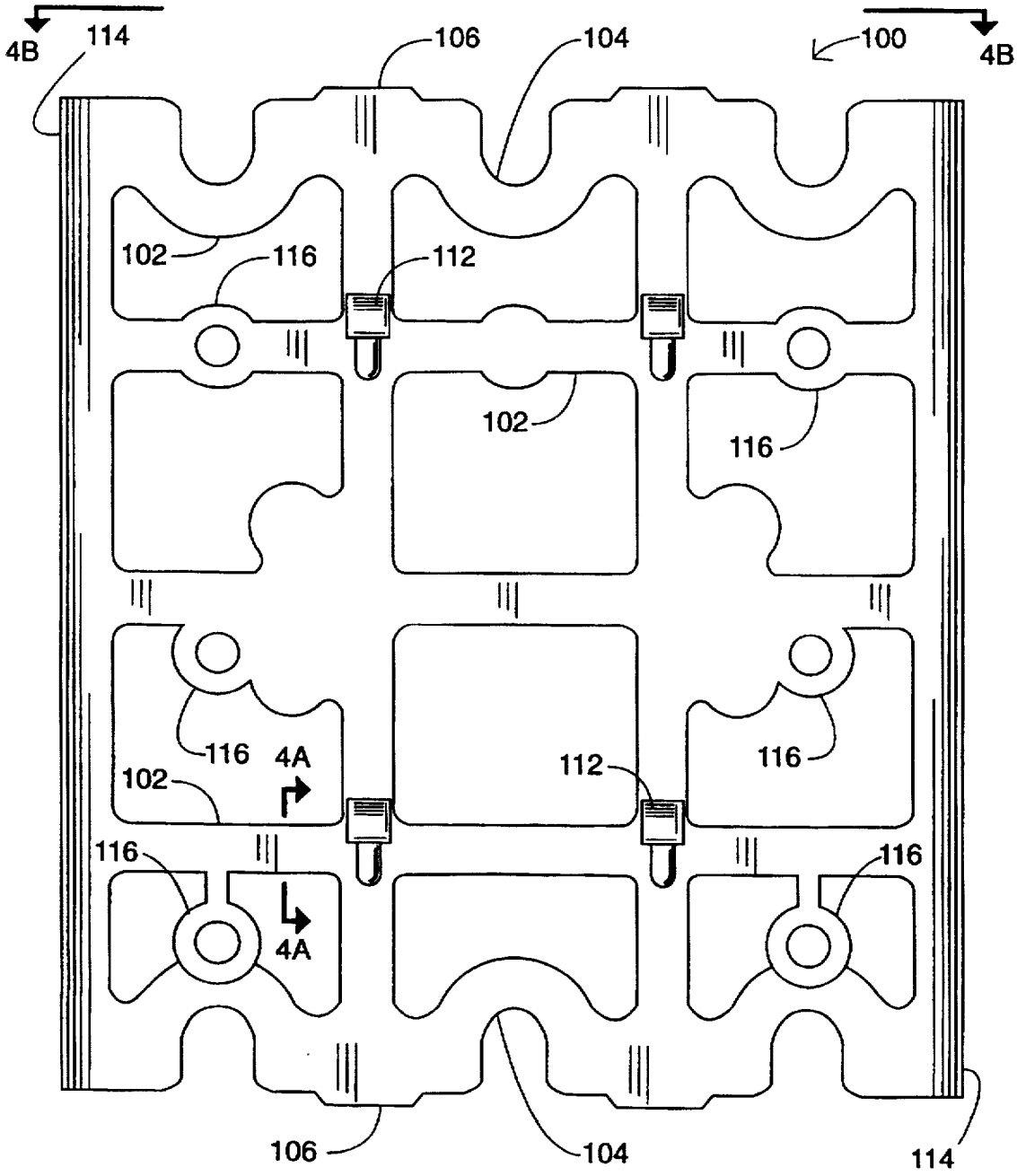
FIG. 4

PALLET SYSTEM INCLUDING END PANELS

The present application is a continuation-in-part application of applicant's application Ser. No. 08/333,436, filed Nov. 2, 1994, now U.S. Pat. No. 5,531,127, the specification of which is incorporated herein in its entirety.

FIELD OF THE INVENTION

The present invention is directed to yarn pallet systems, and, more particularly, to end panels for stabilizing stretch or shrink wrapped pallet systems and for protecting the packages thereon from contact with the stretch or shrink wrap.

BACKGROUND OF THE INVENTION

Materials, such as yarn and webbing, which are roll wound on tubular cores are commonly stored and transported in pallet systems. A preferred type of pallet system comprises a base pallet upon which successive layers of vertically oriented rolls are stacked, respective layers being separated by intermediate panels or separator pads. A top panel is placed over the top layer of rolls. The assembly is then enveloped in shrink wrap or stretch wrap, the wrapping preferably covering all sides of the assembly including the top and bottom. Examples of such pallet systems are described in U.S. Pat. Nos. 4,580,680; 4,667,823; 4,998,619; and in European Application Publication No. 465815 A3 (Ser. No. 9118651.0). Compared to other types of pallet systems having more extensive frameworks, pallet systems as described above are relatively lightweight, inexpensive, recyclable, simple, and versatile. Further, the shrink wrap serves to protect the packages from environmental hazards such as contamination by dust and moisture.

Pallet systems as described above also have significant shortcomings, particularly when used to store and transport delicate goods such as yarns. In the absence of a supplemental framework, the forces created in shrink wrap or stretch wrap cause the file to contact the surface of the outer rolls of yarn. This contact damages the yarn resulting in significant degradation of the yarn quality. In the case of yarn having low denier, such degradation very often results in unacceptable breakage rates and poor dyeability which in turn causes significant manufacturing downtime and rejects.

Another shortcoming of prior art shrink wrap and stretch wrap pallet systems is their limited rigidity. While heavier and more tightly wrapped films may be used, there is an inherent limitation in the degree of rigidity that can be realized. A high degree of rigidity is often required or desired. For example, it is often desirable to stack pallet assemblies on top of one another. Moreover, the stresses involved in transporting package assemblies are often substantial.

In an attempt to overcome the aforementioned shortcomings of shrink wrapped and stretch wrapped pallet systems, such pallet systems have been provided with corner posts. Corner posts may serve to space the wrap from the yarn but do very little to stabilize the package. Furthermore, corner posts require a bulkier or more complicated return package (i.e., the pallet system in disassembled configuration for return to the supplier) and have short useful lives because of damage sustained in return. Corner posts significantly complicate the loading procedure requiring that four posts be held in place while the top panel is installed. Moreover, corner posts do not lend themselves to automation.

Thus, there exists a need for a supplemental framework for maintaining space between a shrink wrap or stretch wrap film of a pallet system and the rolls or packages loaded thereon. Further, there exists a need for such a framework which provides additional rigidity to the structure, particularly lateral rigidity. There exists a need for such a framework which does not significantly increase the size of the return package and which lends itself to automatic assembly.

SUMMARY OF THE INVENTION

The present invention is directed to a pallet system including shrink wrap or stretch wrap which overcomes the shortcomings and limitations of the prior art by the provision of opposed end panels extending between the upper and lower panels or pallets over which the wrap is placed. The end panels are arranged and configured so as to mount on opposite ends of vertically stacked packages, effectively connecting a base pallet and a top panel. The end panels themselves are spaced from the periphery of the rolls. Further, the vertical edges of the end panels extend beyond the periphery of the rolls thereby defining a plane between respective end panels, the plane serving to space the wrap, which lies substantially therein, from the rolls. The end panels are conveniently sized and shaped to fit within the area of the base pallet, intermediate panels and top panel thereby providing a relatively compact return package.

More particularly, the present invention is directed to a pallet system for storing and transporting at least one package and for use with a wrapping film as follows. A base pallet is provided which has an end edge. A longitudinally extending groove is formed along the end edge of the base pallet. The groove includes a bottom wall, an outer wall and an inner wall. The outer and inner walls extend upwardly on opposed sides of the bottom wall. A top panel overlies the base pallet. An end panel is adjacent the base pallet and has a lower edge. The lower edge of the end panel is removably disposed in the groove, the lower edge adjacent the bottom wall and interposed between the inner and outer walls. The end panel is arranged and configured such that, when the lower edge is disposed in the groove, the at least one package is disposed between the base pallet and the top panel and the wrapping film is placed around the pallet system, the end panel separates the wrapping film from at least a portion of the package.

In one embodiment, the present invention is directed to a pallet system for storing and transporting at least one package having a periphery and for use with a wrapping film, as follows. A base pallet is provided having a first end and a second end. First and second longitudinally extending grooves are formed along the first mad second ends, respectively. The grooves each include a bottom wall, and outer wall and an inner wall. The outer and inner walls extend upwardly on opposed sides of the respective bottom wall. A top panel is provided having a first and a second end. A first end panel extends between the first end of the base pallet and the first end of the top panel, and forms an end wall extending therebetween. The first end panel has a lower edge, a left edge and a right edge. The lower edge of the first end panel is removably disposed in the first groove, the lower edge of the first end panel being adjacent the bottom wall and interposed between the inner and outer walls of the first groove. A second end panel extends between the second end of the base pallet and the second end of the top panel and forms an end wall extending therebetween. The second end panel has a lower edge, a left edge and a right edge. The lower edge of the second end panel is removably disposed in the second groove, the lower edge of the second end panel adjacent the bottom wall and interposed between the inner and outer walls of the second groove. The left and right edges of respective end panels are configured such that, when the lower edges of the first and second end panels are disposed in the first and second grooves, respectively, the at least one package is disposed between the first and second end panels and the wrapping film is wrapped about the pallet system in tension, the left and right edges of respective end panels extend beyond the periphery of the at least one package. The left edges of the first and second end panels form a left side plane of film and the right edges of the first and second end panels form a right side plane of film. The left and right side planes of film are spaced from the at least one package.

The pallet system as just described may further include at least one intermediate panel interposed between the base pallet and the top panel. A locator projection extends from the at least one intermediate panel. Each of the first end panel and the second end panel includes a cut-out adapted to receive the locator projection. Preferably, each of the cut-outs includes a recess arranged and configured to engage the locator projection so as to minimize movement of the end panel relative to the locator projection.

The present invention is further directed to a method of assembling a pallet system. A package is placed on a base pallet. A pair of end panels are mounted on opposite ends of the base pallet, the end panels being arranged and configured so as to extend upwardly from the base pallet beyond the perimeter of the package. A top panel is placed on the package and on upper edges of the end panels. A tensile film wrap is applied over the base pallet, the top pallet, and the end panels whereby the film wrap is maintained in spaced relation with the package on all sides. The step of mourning a pair of end panels may include inserting lower edges forming a part of each end panel into a corresponding longitudinal groove extending along the opposed ends of the base pallet.

The present invention is further directed to a method of assembling a pallet system, as follows. A pair of end panels are temporarily mourned on opposite ends of a base pallet such that the panels each angle outwardly from the center of the base pallet. A package is placed on the base pallet. The end panels are pivoted inwardly toward the center of the base pallet into a vertical position. A top panel is placed on upper edges of the end panels and the package. A tensile film wrap is applied over the base pallet, the top pallet, and the end panels whereby the film wrap is maintained in spaced relation with the package on all sides. The step of mounting a pair of end panels may include inserting lower edges forming a part of each end panel into a corresponding longitudinal groove extending along the opposed ends of the base pallet.

In a further embodiment of the present invention, side panels are provided which cooperate with the end panels and provide additional protection for the packages and stability to the pallet system.

An object of the present invention is to provide a supplemental framework for maintaining space between a shrink wrap or stretch wrap film of a pallet system and the rolls or packages loaded thereon.

An object of the present invention is to provide a framework which provides additional rigidity to a shrink wrapped or stretched wrapped pallet system structure, particularly lateral rigidity.

An object of the present invention is to provide a supplemental framework for a pallet system as described above which does not significantly increase the size of the return package.

An object of the present invention is to provide a supplemental framework of the type described above for use with a pallet system which lends itself to automatic assembly.

An object of the present invention is to provide a supplemental framework for a pallet system as described above which may be used with pre-existing pallet system components with little or no modification to such components.

An object of the present invention is to provide a supplemental framework for a shrink or stretch wrap pallet system which is durable and reusable.

BRIEF DESCRIPTION OF THE DRAWINGS

FIG. 4 is a plan view of a second embodiment of an end panel according to the present invention.

DETAILED DESCRIPTION OF THE INVENTION

Figure 1:
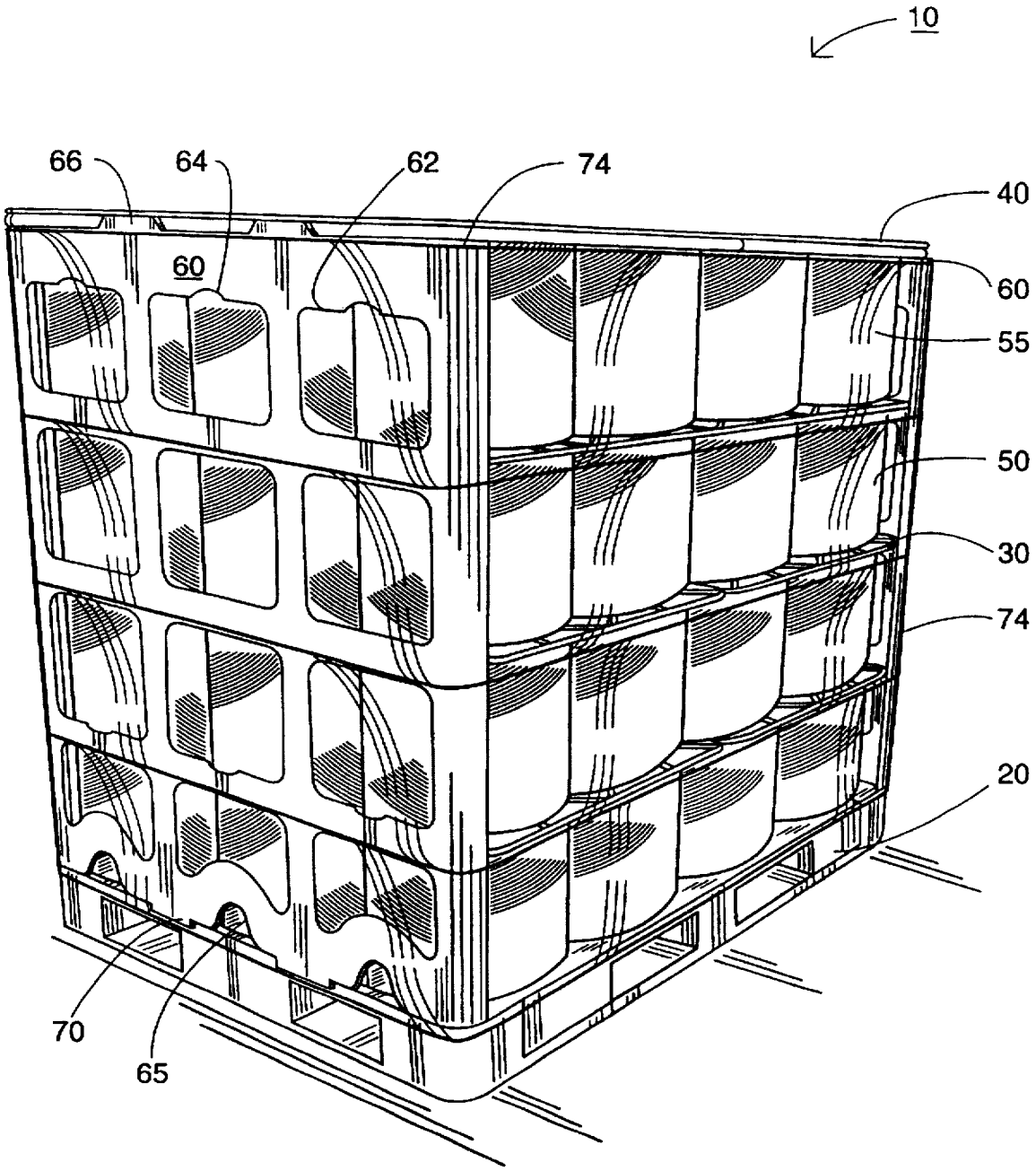
FIG. 1 is a perspective view of a pallet system according to the present invention in a loaded configuration.
Figure 2:
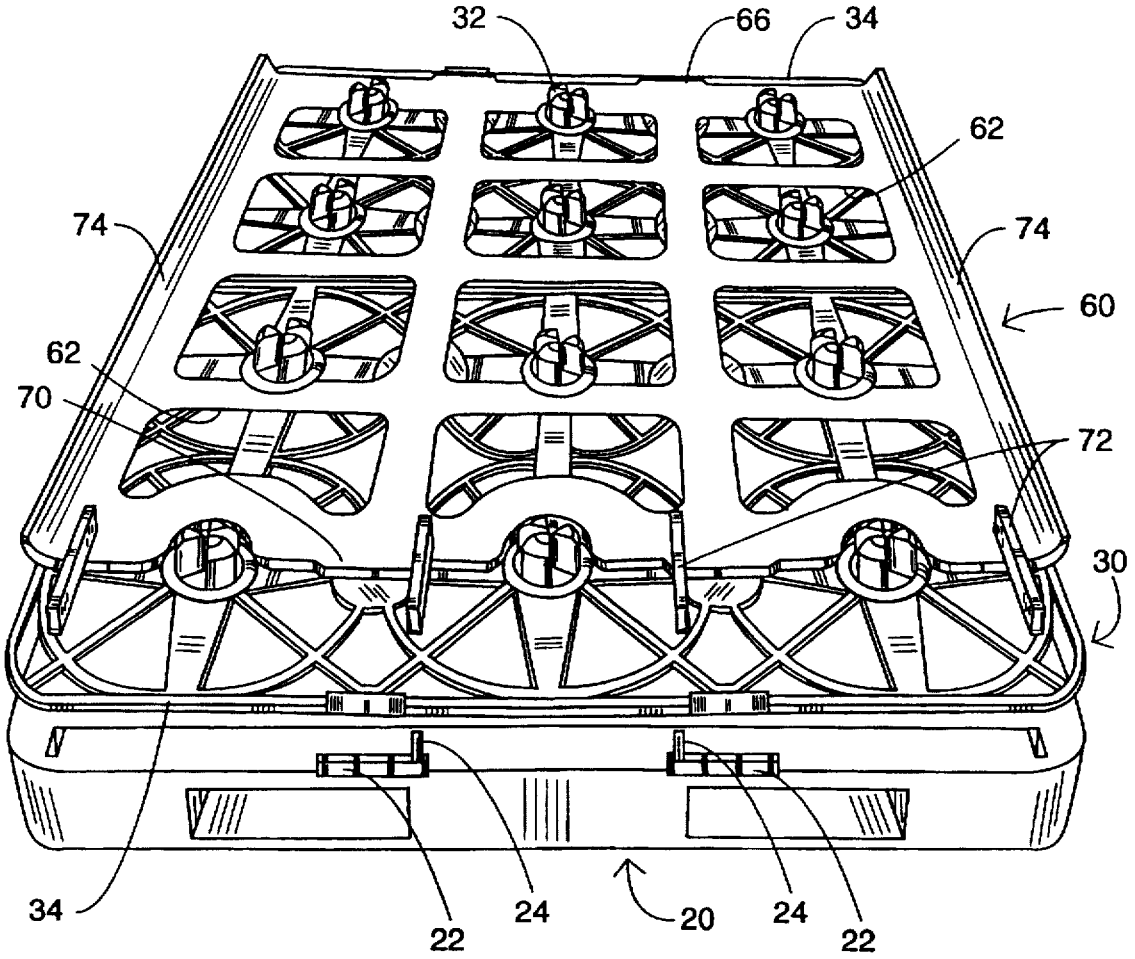
FIG. 2 is a perspective view of a pallet system according to the present invention showing an end panel stacked on an intermediate panel.
Figure 3:
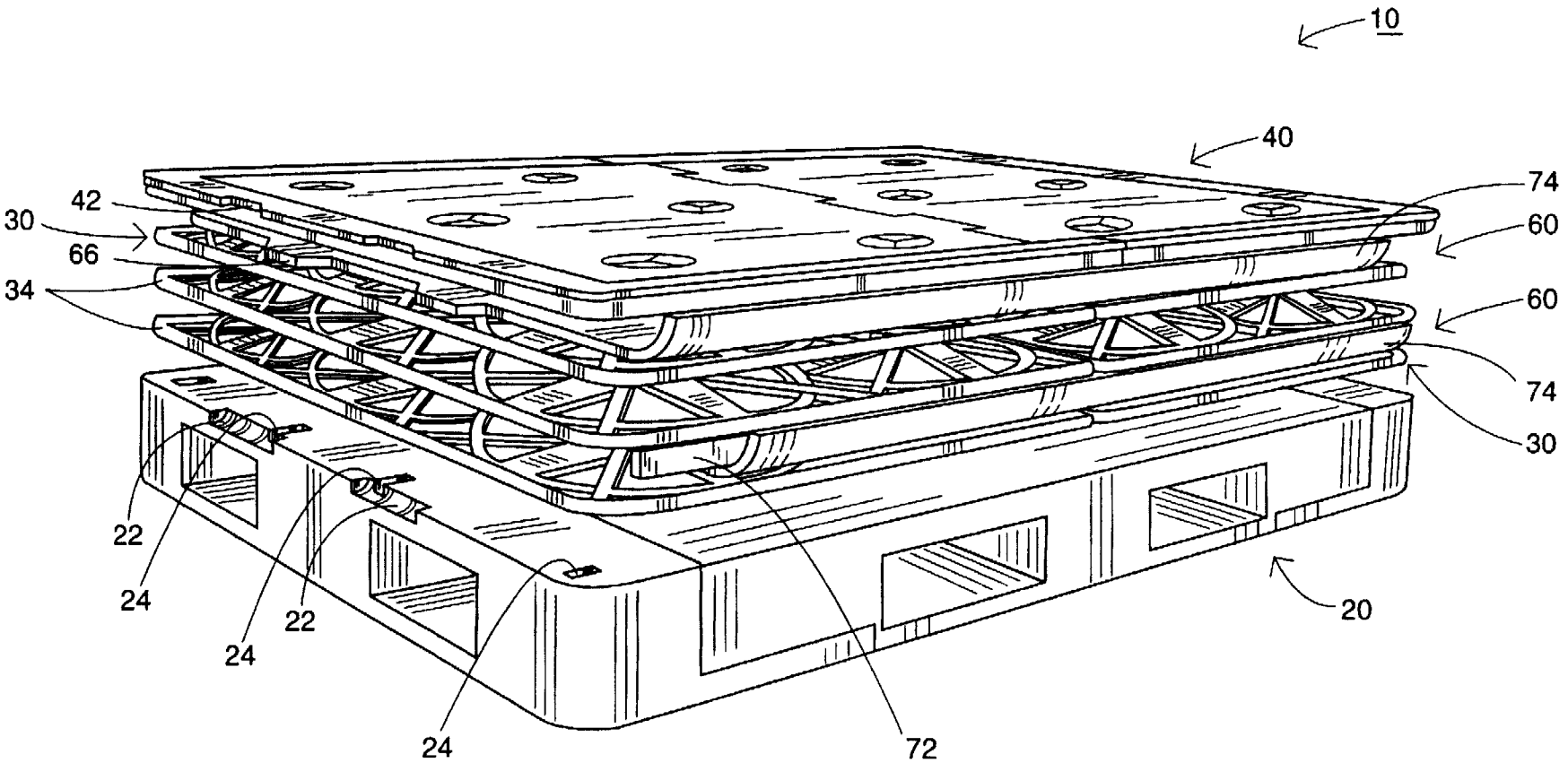
FIG. 3 is a perspective view of a pallet system according to the present invention in a return configuration.

With reference to the drawings and to FIGS. 1–3 in particular, a pallet system 10 according to the present invention is shown therein. As best seen in FIG. 1, pallet system 10 comprises base pallet 20, top panel 40, intermediate panels or separator pads 30, and end panels 60. Rolls, spools, packages, or the like 50 are confined in spaced relation within pallet system 10. Pallet system 10 further comprises shrink wrap film or stretch wrap film 55 which preferably envelopes pallet system 10 on all six sides. Suitable shrink and stretch wraps include preferably polyethylene film having a thickness of about 0.0003 inch to 0.0008 inch for the shrink wrap and of about 0.003 to 0.008 for the stretch wrap. However, it will be appreciated that the pallet system of the present invention may be used with any suitable wrap.

Base pallet 20 is substantially conventional. Recesses 22 and slots 24 are provided to cooperate with end panel 60 as discussed hereinafter. Base pallet 20 is preferably formed from polyethylene or polypropylene. It will be appreciated that a separator pad such as an intermediate panel 30 may be used in place of the base pallet.

Figure 5:
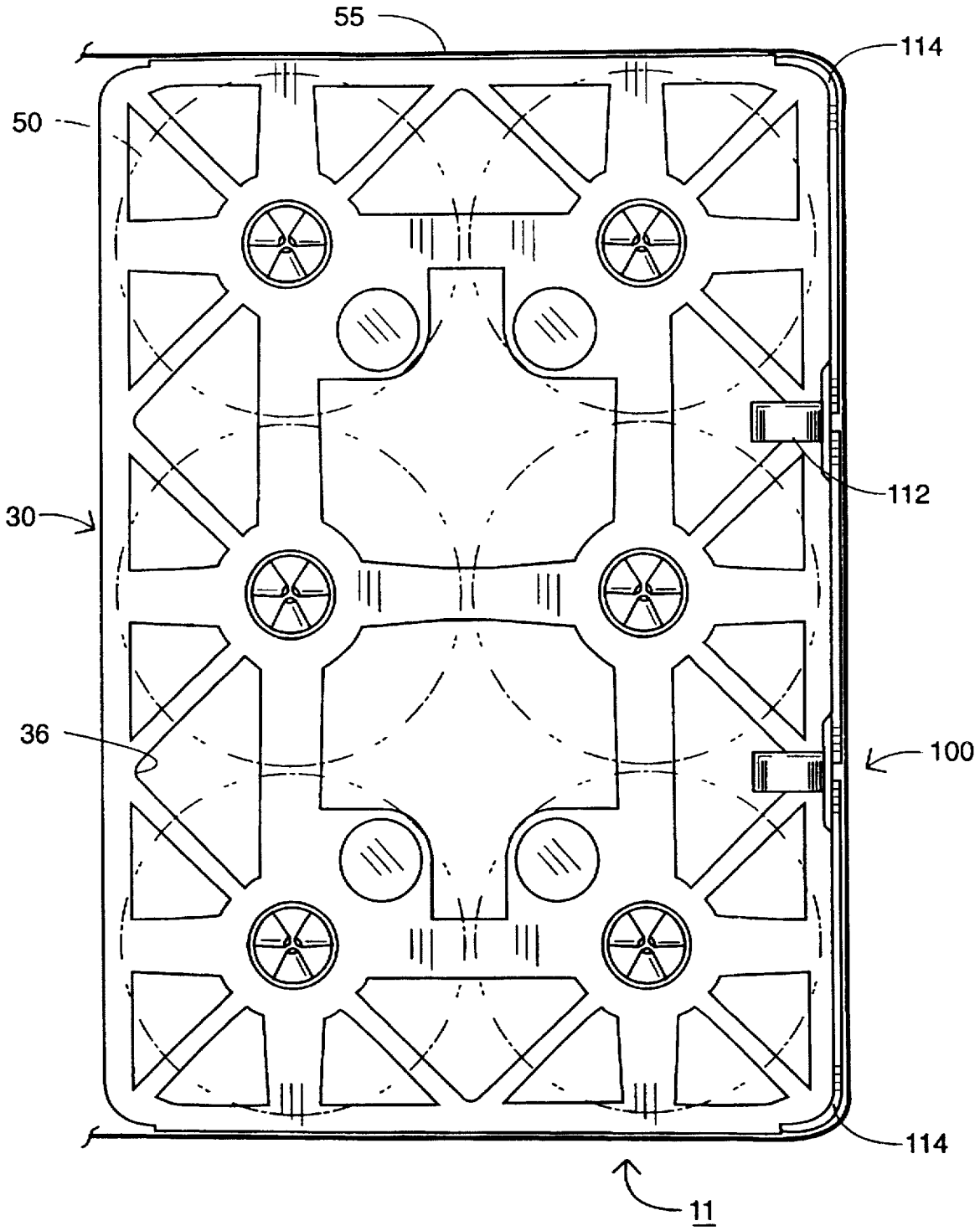
FIG. 5 is a top view of an end panel according to the second embodiment of the present invention mounted on an intermediate panel wherein the yarn spools are shown schematically.

Intermediate panels 30 have locator projections 32 for locating respective rolls 50, projections 32 being designed to fit within the hollow roll core. Intermediate panels 30 may be of one or two piece design. As best seen in FIG. 5, recesses 36 are provided to cooperate with hooks 112 of panel 100 according to a second embodiment the present invention, as discussed hereinafter. Intermediate panel 30 is preferably formed from polyethylene or polypropylene.

Top panel 40 is conventional and may be of a one or two piece design. Recesses 42 are provided to cooperate with end panel 60 as discussed below. Top panel 40 is preferably formed from polyethylene or polypropylene.

End panel 60 is preferably molded from polyethylene or polypropylene or any other suitable material. End panel 60 may be formed by, for example, vacuum molding, low pressure injection molding, or high pressure injection molding. End panel 60 may be reinforced using a framework of metal or glass fibers, for example. Cutouts 62 are provided to lighten end panel 60. As best seen in FIG. 2, cutouts 62 further serve to receive locator projections 32 of intermediate panels 30 during storage and shipping. It will be appreciated that the cutouts are not necessary so long as provision is made for receiving projections 32. Upper recesses 64 and lower recesses 65 are sized and positioned so as to fit closely with the projections 32 received therein. The close fit provides for positive registry of end panel 60 on intermediate panel 30 and holds end panel 60 in place during transport in the return position (as shown in FIG. 3).

Upper locator tabs 66 are sized and configured to fit snugly with recesses 42 in top panel 40. Lower locator tabs 70 are likewise designed to fit within recesses 22 of base pallet 20. Prongs 72 are sized and configured to engage slots 24 of base pallet 20. In order to practice a second method of assembling pallet system 10 as discussed below, slots 24 are preferably wider, at least at the lower portions thereof, than prongs 72 so that prongs 72 may be pivoted in slots 24 about a horizontal axis. For other methods of assembly, prongs 72 and slots 24 may be substantially complementary.

Shoulders 74 are formed on each of the vertical edges of end panel 60 and provide additional rigidity to the pallet system and protection for the spool as discussed below. Shoulders 74 also help to locate the end panel with respect to the base pallet and top and intermediate panels during assembly. As shown, shoulders 74 are molded integrally with end panel 60. Alternatively, shoulders 74 may be hingedly mounted along the side edges of end panel 60 allowing for a more compact return package as discussed below.

Also, shoulders 74 may be flat and form a corner with end panel 60 rather than forming a radius as shown in the figures. It has been found that the flat corner design facilitates the alignment of the end panel with the other components during installation as discussed below. Preferably, an angle of about 135° is provided between the end panel and the shoulder.

End panel 60 may also include means for further supporting it on the base pallet, top panel, and/or intermediate panels such as, for example, one or more horizontally disposed shoulders adapted to rest on those components. Such provision may be advantageous when retrofitting the end panels on base pallets which do not extend beyond the intermediate and top panels. The horizontal shoulders also help to resist compression and sagging of the end panel under the forces of the wrap.

The pallet system according to the first embodiment may be loaded in at least two ways.

According to a first method, pallet 20, intermediate panels 30, and top panel 40 are assembled with spools 50 interposed between respective layers. Next, prongs 72 are inserted into slots 24 and tabs 66 and 70 are placed in registry with recesses 42 and 22, respectively. The recesses or tabs may advantageously be provided with releasable snap-lock means (not shown) for holding the components together. The assembly is then shrink wrapped or stretch wrapped.

According to a second method, prongs 72 of end panels 60 are inserted into slots 24 of base pallet 20 and end panels 60 are pivoted about their lower edges and thereby angled outwardly from the center of pallet 20. A layer of spools 50 are placed on pallet 20 followed by an intermediate panel 30, another layer of spools and so forth until finally top panel 40 is positioned. End panels 60 are pivoted back to vertical such that tabs 66 and 70 find registry with recesses 22 and 42, respectively. Optionally, horizontal grooves (not shown) may be provided in end panels 60 to capture the edges of intermediate panels 30 as the end panels are positioned. Finally, the assembly is shrink wrapped or stretch wrapped.

As best seen in FIGS. 4 and 5, a pallet system 11 according to a second embodiment is the same as the pallet system 10 according to the first embodiment except that the end panels are configured differently and the intermediate panels are modified.

More particularly, end panels 100 are vertically and horizontally symmetric. Similar to the end panels of the first embodiment, end panels 100 are provided with cutouts 102, shoulders 114, and locator tabs 106. Recesses 104 are provided for receiving projections 32. Additionally, automation rings 116 are provided to cooperate with automatic handling means (not shown). Hooks 112 are secured to end panels 100 and designed to engage recesses 36 formed in intermediate panel 30.

Pallet systems 11 according to the second embodiment may be assembled as follows. First, the base pallet, spools, intermediate panels, and top panel are stacked as previously described. Then, end panels 100 are lowered vertically on to the assembly so that hooks 112 engage recesses 36 thereby holding end panels 100 in place. If needed, the assembly with end panels mounted may be transported by forklift, conveyor, or other suitable means to a wrapping station. Thereafter shrink wrap or stretch wrap is applied.

Figure 10:
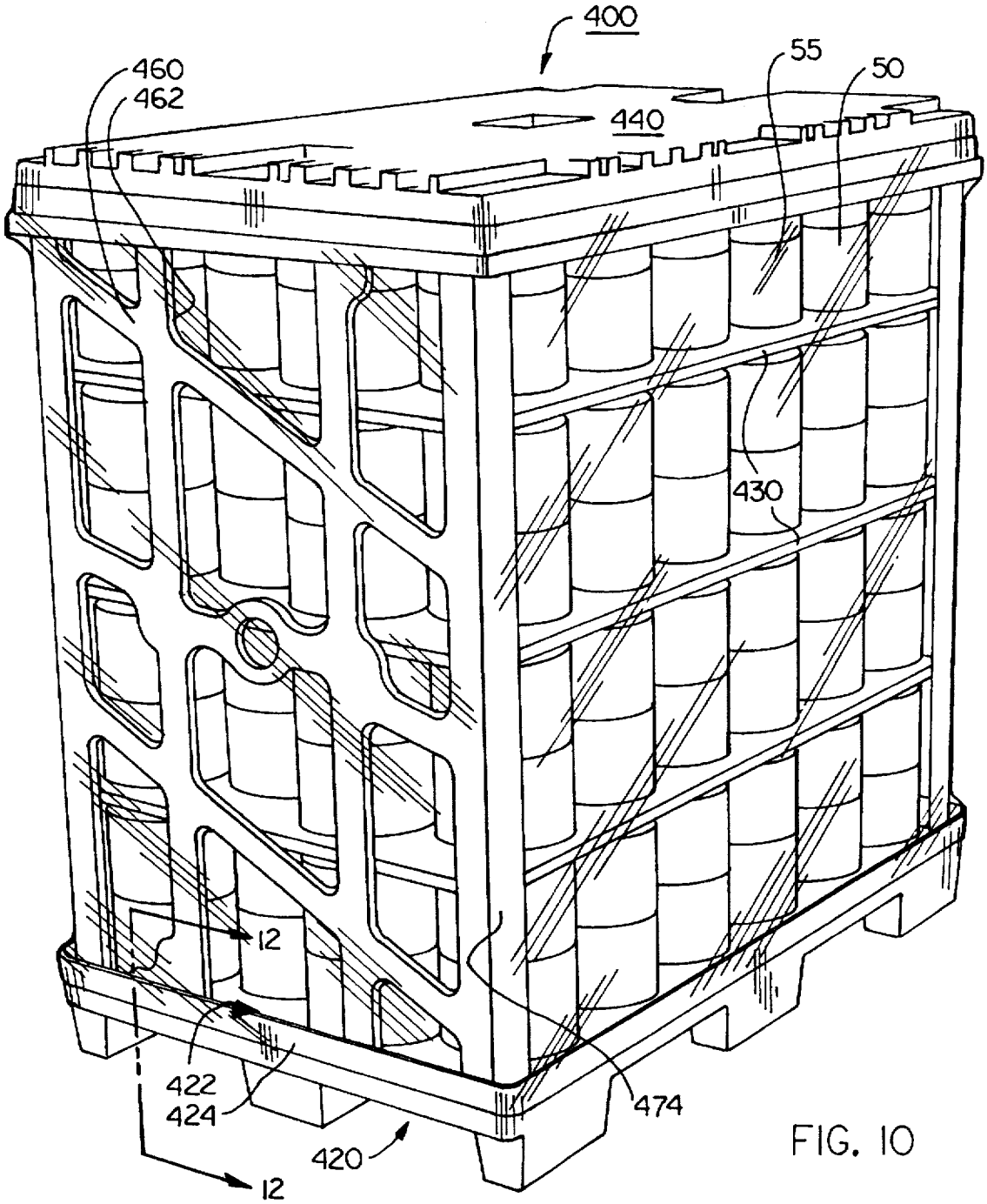
FIG. 10 is a perspective view of a pallet system according to a further embodiment of the present invention in a loaded configuration.
Figure 11:
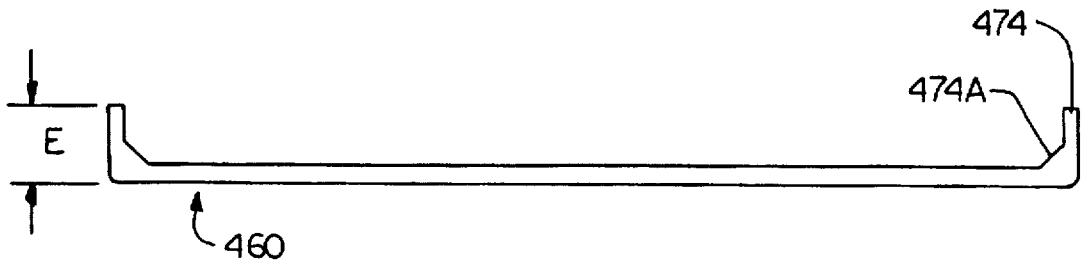
FIG. 11 is a top view of an end panel forming a part of the pallet system of FIG. 10.
Figure 12:
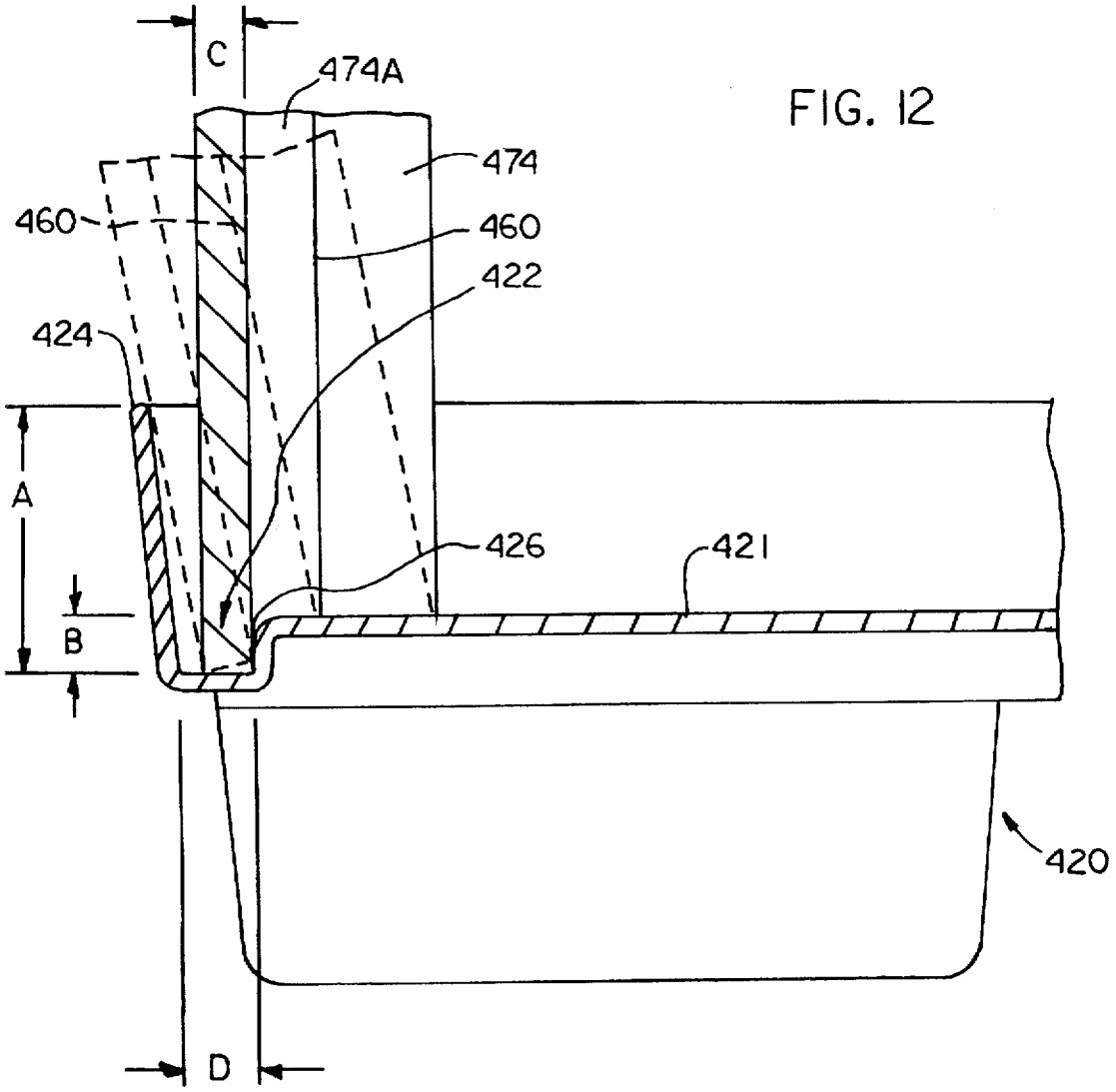
FIG. 12 is a fragmentary, side, cross sectional view of the pallet system of FIG. 10 taken along the line 12—12, the packages and wrap being removed, showing an end panel thereof positioned in the base pallet.

With reference to FIGS. 10–12, a base pallet system 400 according to a further embodiment of the present invention is shown therein. Pallet system 400 includes base pallet 420, top panel 440, end panels 460, and intermediate panels 430. Packages 50 are contained in pallet system 400 and supported by intermediate panels 430 and base pallet 420. Pallet system 400 includes shrink or stretch wrap 55 wrapped thereabout to form a stable and sealed package storage and transportation assembly. As best seen in FIG. 12, when pallet system 400 is assembled as shown in FIG. 10, the lower and upper edges of end panel 460 are seated in groove 422 of bottom pallet 420 and a corresponding groove (not shown) formed in top panel 440.

With reference to FIGS. 10 and 12, base pallet 420 is provided with peripheral groove 422, preferably integrally formed therein. In particular, groove 422 is formed by outer wall 424, inner wall 426, and a bottom wall 428 extending therebetween. Preferably, outer wall 424 extends continuously about the perimeter of base pallet 420. Inner wall 426 may also be a continuous wall. Preferably, inner wall 426 is the end edge of support surface 421 as shown. However, inner wall 426 may include a projection or series of spaced apart projections extending upwardly from support surface 421, particularly if support surface 421 is level with or below the height of bottom wall 428. Base pallet 420 is preferably formed from the same materials as pallets 10 and 11 as discussed above. Locator projections (not shown) similar to locator projections 32 may be secured to or integrally formed with support surface 421 and extend upwardly therefrom.

Top panel 440 is preferably formed from the same materials as discussed above with regard to the top panels of pallet systems 10 and 11. Top panel 440 preferably includes a groove (not shown) arranged and configured in substantially the same manner as groove 422 of the bottom panel. Top panel 440 may in fact be identical to bottom panel 420, but rotated 180° when assembled in pallet system 400. It is not necessary that top panel 440 include a groove corresponding to groove 422 of the base pallet. However, it has been found that the provision of such a groove or a similar corresponding structure is beneficial to prevent deflection of the upper corners of the end panel under the load of the wrap 55 and any loads placed on top of top panel 440, such as further pallet systems.

As best seen in FIG. 11, end panel 460 includes shoulders 474 having inner bearing surfaces 474A. Bearing surfaces 474A are forced into engagement with the corners of intermediate panels 430 and thereby stabilize the intermediate panels when pallet system 400 is assembled with wrap 55. Shoulders 474 preferably have a length of from about 1.5 inches to about 2.5 inches. The lengths of shoulders 474 should not exceed the spacing between the intermediate panels when they are nested in the return configuration. Inner bearing surfaces 474A preferably form an angle of about 45° with respect to the body of end panel 460. With reference to FIG. 10, end panels 460 are provided with cutouts 462 corresponding to cutouts 62 of pallet system 10. End panels 460 are preferably formed from the same materials as discussed above with regard to end panels 60 of pallet system 10.

As noted above, the lower and upper edges of end panel 460 are seated in groove 422 of base pallet 420 and a corresponding groove (not shown) formed in the underside of top panel 440, respectively, when pallet system 400 is assembled. The tension of wrap 55 serves to pull the top and bottom pallets toward one another, holding the ends of end panels 460 against bottom wall 428 and the corresponding wall of the top panel. The tension of wrap 55 also pulls end panels 460 toward one another, holding bearing surfaces 474A of end panel 460 against the corner edges of intermediate panels 430. Preferably, the lower and upper ends of end panels 460 bear against inner wall or projection 426 of base pallet 420 and the corresponding structure of top panel 440. Preferably, outer wall 424 has a height A of from about 2 inches to about 3 inches to support the end panel in the tilted position. Inner wall or projection 426 only needs a height B from bottom wall 428 in the range of from about 0.5 inch to about 1.0 inch to provide a stop for end panel 460. Bottom wall 428 preferably has a width D in the range of from about ⅝ inch to about 0.75 inch to permit easy insertion of end panel yet provide support in the pivoted position as described above. End walls 460 preferably have a width C, at least at the portion inserted into groove 422, which is from about 1/16 to about ⅛ inch less than width D of the groove.

Pallet system 400 may be loaded in at least two ways, similar to those discussed with regard to pallet system 10.

According to a first method, base pallet 420 and intermediate panels 430 are assembled with packages 50 interposed between respective layers. Next, the lower ends of end panels 460 are inserted into opposed end portions of groove 422. Thereafter, top panel 440 is placed on top of the upper ends of end panels 460 and the top layer of packages 50. The assembly is then wrapped with wrap 55.

According to a second method, the lower ends of end panels 460 are placed in opposed end portions of groove 422 such that they tilt outwardly and away from each other, assuming the position as indicated by dotted lines in FIG. 12. That is, end panels 460 are pivoted about their lower edges and thereby angled outwardly from the center of base pallet 420. Preferably the degree of tilt is from about 5° to about 10°. A layer of packages 50 are placed on pallet 420 followed by an intermediate panel 430, another layer of packages and so forth until the final layer of packages is positioned. End panels 460 are then pivoted back to vertical (as shown in solid lines in FIG. 12). Thereafter, top panel 40 is placed on top of the top layer of packages 50 and the upper ends of end panels 460. Finally, the assembly is shrink wrapped or stretch wrapped.

It will be appreciated that once assembled and wrapped, pallet systems 10, 11, 400 will have superior rigidity and stability. The pallet systems have a strong resistance to sideways lateral forces. This is because the end panels provide a rigid structure that must be either deformed or pivoted about one of its corners. The tendency toward deformity is a function of the material used to form the end panels which is preferably lightweight and rigid. The tendency of the end panels to pivot is greatly reduced by the shrink wrap or stretch wrap which tends to maintain the upper and lower edges of the end panels in flush contact with the top panel and base pallet, respectively. Hence, the tensile strength of the shrink wrap or stretch wrap must be overcome in order to pivot the end panels.

Lateral motion of the pallet systems due to endwise forces is also significantly inhibited. Again, the end panels must either be deformed or pivoted in order for motion to occur. Pivoting is resisted by shoulders 74 which form walls along the planes perpendicular to the planes of the end panels. The length of the shoulders and the resultant degree of resistance to motion will depend on the desired return size and the dimensions of the other components of the pallet system (as discussed below).

Furthermore, the shrink wrap or stretch wrap itself provides greater resistance to motion than in conventional shrink wrap and stretch wrap pallet systems. This is because the shoulders create a more or less uniform plane of shrink wrap or stretch wrap on either side. The uniform plane provides substantially a single stress zone which makes more efficient use of the tensile strength of the wrap. Restated, deflection of the pallet system is reduced because unified panels of wrap are created. Furthermore, "bellying" in the corners is reduced. While it is preferable that the shoulders extend as far as the side edges of the intermediate panels as shown in the figures, it has been found that the shoulders reduce bellying even if they do not extend that far, albeit to a lesser extent.

It will be appreciated that spools 50 loaded on pallet systems 10, 11, 400 are free of contact with shrink wrap or stretch wrap 55. As best seen in FIG. 5 (for the purposes of this discussion, end panels 60, 100, and 460 function the same), the end panels themselves hold wrap 55 from spools 50 on the sides covered by the end panels. On the open sides, wrap 55 is spaced from spools 50 by the shoulders which shape planes which are distanced from the spools.

Side panels (not shown) may also be implemented in conjunction with the end panels of the first and second embodiments described above. The side panels preferably have the sin.he or similar construction as the end panels.

Preferably, the side panels include means for detachably securing the side panels to the assembly and/or for registering the side panels similar to that of the end panels. The side panels may be formed so as to cooperate with the shoulders or, in the alternative, the shoulders may be eliminated. The side panels may be formed with their own shoulders. Furthermore, the side panels need not extend all the way to the end panels and may be held in position for wrapping by, for example, snap means found in the base pallet and top panel or hooks. It will be appreciated that the side panels provide the stone stabilizing and protecting functions as discussed above with respect to the end panels.

As best seen in FIGS. 2 and 3, pallet systems according to either the first embodiment, the second embodiment, or the third embodiment may be assembled in return packages having substantially the same volume requirements as pallet systems not having end panels. Typically, intermediate panels do not fit together flush, there being some space between them even when stacked without spools. End panels 60, 100, and 460 preferably have a width less than the space between stacked intermediate panels. Projections 32 and the corresponding component of pallet 420 (not shown) are received in cutouts 62 and 462. Shoulders 74, 474 are preferably slightly wider than intermediate panels 30, 430 such that they flank the side edges of panels 30, 430 when stacked as shown in the figures. If shoulders 74, 474 are hingedly mounted on the side of end panels 60, 460, they may be folded onto the end panels. End panels 60, 460 are preferably shaped such that they will nest when laid one atop the other, should such a return configuration be desired. It will be appreciated from the figures and from the foregoing description, that pallet systems according to the present invention may be constructed which are no greater in size in the return configuration than similar pallet systems having no end panels.

Figure 6:
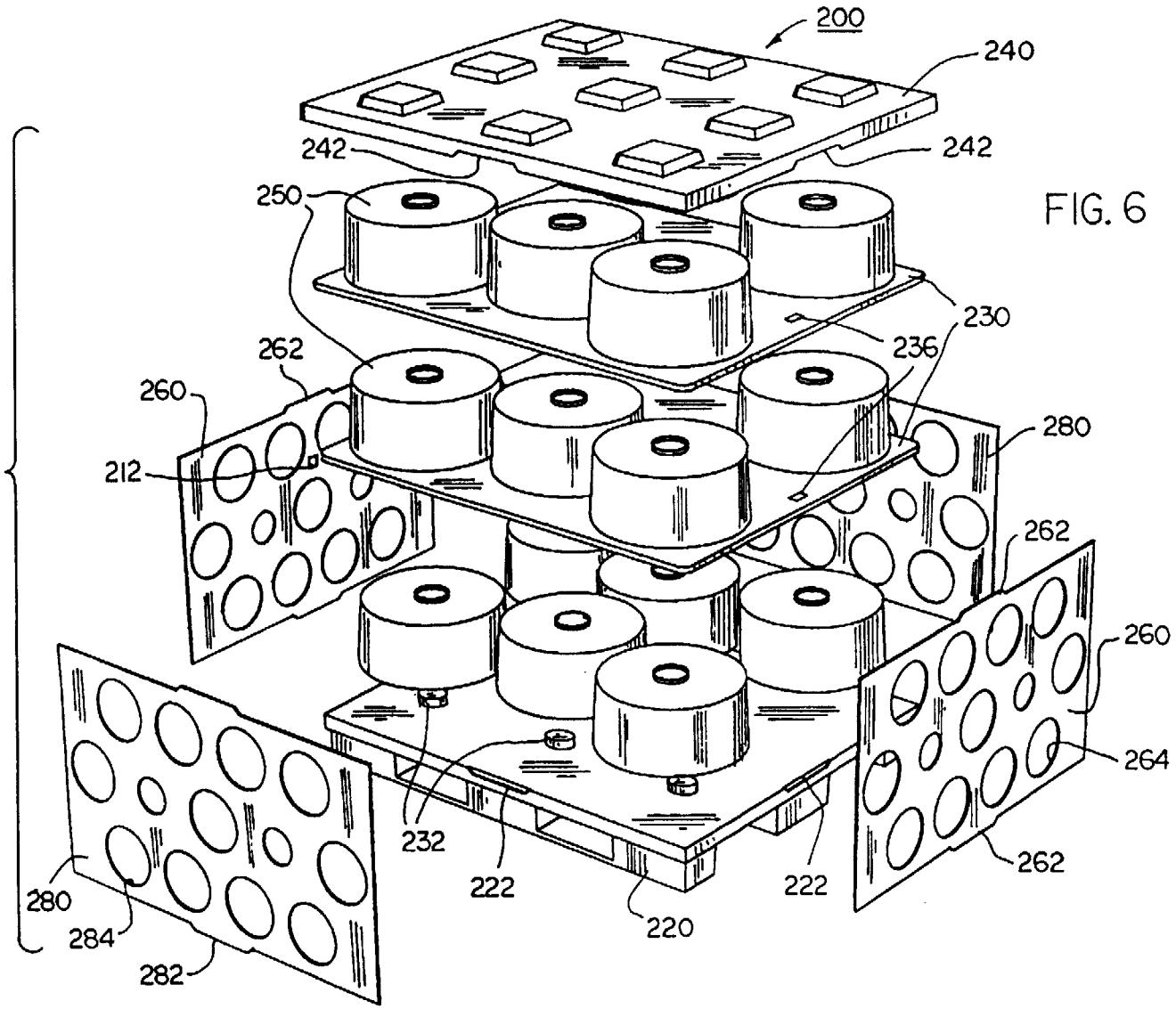
FIG. 6 is an exploded perspective view of a pallet system according to the present invention having side panels.
Figure 7:
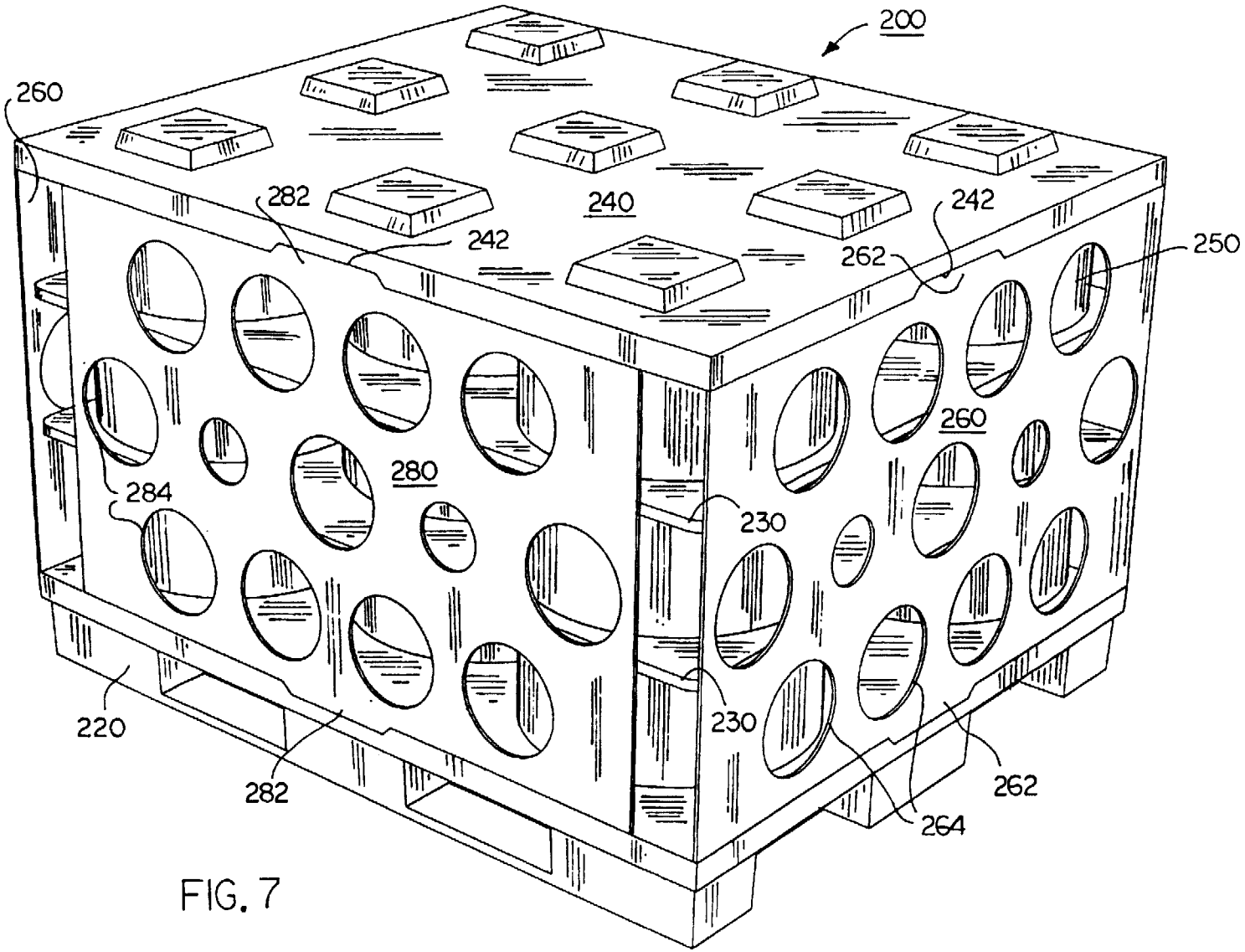
FIG. 7 is a perspective view of the pallet system of FIG. 6 in an assembled configuration.
Figure 8:
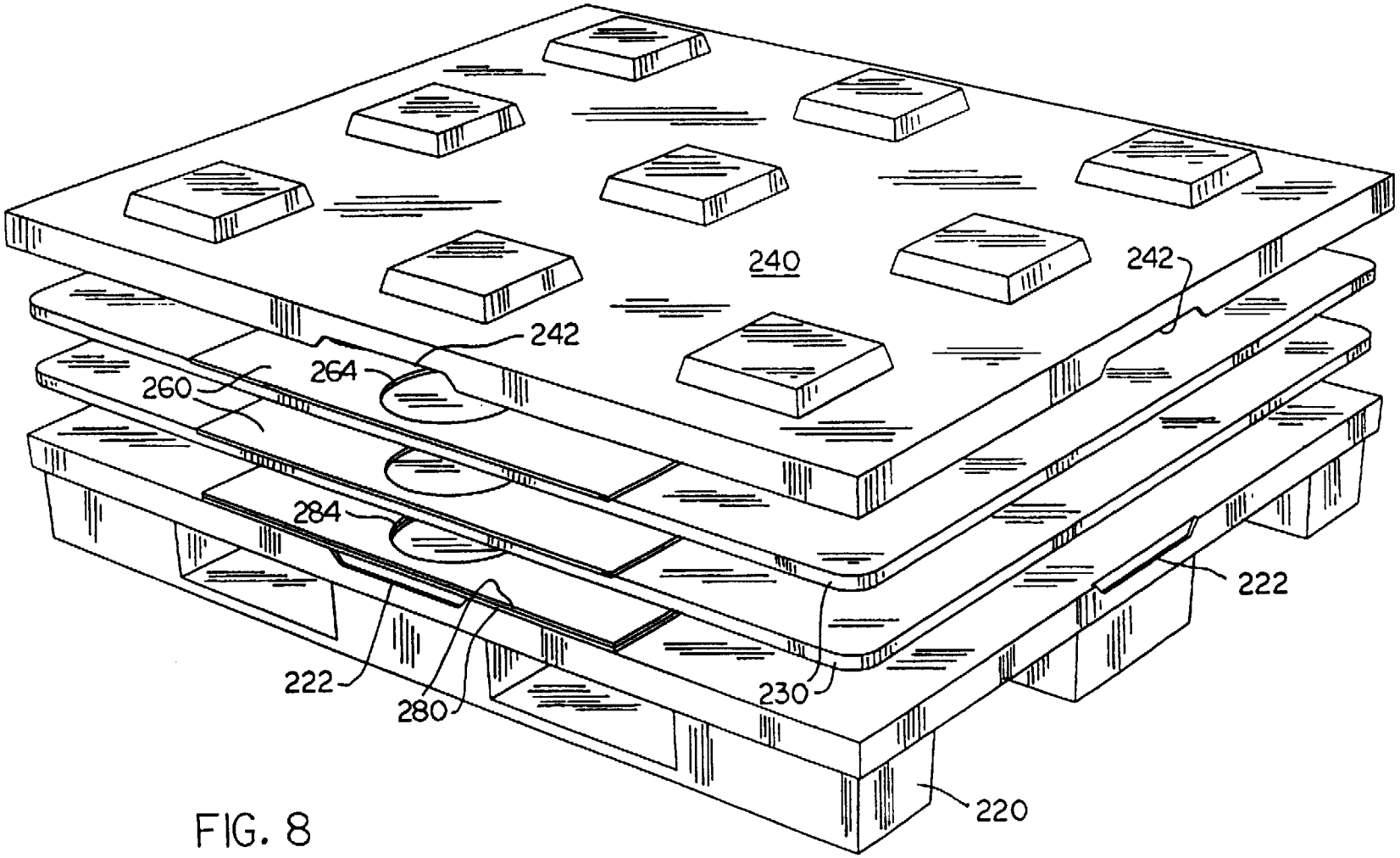
FIG. 8 is a perspective view of the pallet system of FIGS. 6 and 7 in a return configuration.

A pallet system 200 according to the present invention using a pair of side panels 280 in conjunction with a pair of end panels 260 is shown in FIGS. 6–8. Pallet system 200 includes top panel 240, base pallet 220, and intermediate panels 230 which may be of the same construction as top panel 40, base pallet 20, and intermediate panels 30 of the first embodiment, respectively, except for the following modifications. Base pallet 220 includes recesses 222 formed therein to receive and locate tabs 262 and 282 formed along the edges of end panels 260 and side panels 280, respectively. Intermediate panels 230 have slots 236 formed therein to receive hooks 212 (only one of which is visible in the figures) which are mounted on the inner surface of each of end panels 260 and side panels 280. Pallet system 200 is designed to be wrapped with a stretch or shrink wrap film as discussed above. The wrapping film has been omitted from the figures for clarity.

End panels 260 and side panels 280 are preferably formed by the same methods and from the same materials as end panels 60, 100 described above. End panels 260 and side panels 280 have cut-outs 264 and 284, respectively, formed therein to receive nodes 232 of intermediate panels 230 when pallet system 200 is in the return configuration, as shown in FIG. 8.

Preferably, end panels 260 and side panels 280 are interchangeable, that is, they are of the same size, shape, and configuration. In many conventional pallet systems, the base pallet, intermediate panels and top panel are longer than they are wide as shown in the figures. Therefore, when panels 260, 280 are mounted on pallet system 200 as shown in FIG. 7, there will remain gaps on the sides of pallet system 200 between the edges of side panels 280 and end panels 260. Because end panels 260 extend substantially the entire width of pallet system 200, rolls 250 are protected from the wrapping film. Because side panels 280 have a length approximately equal to the width of panel system 200, they may be returned as shown in FIG. 8, thereby simplifying the return packaging process. Moreover, a reduction in the overall weight of the package is realized. Side panels 280 still provide stability to the pallet system. The preferred length depends upon the particular requirements of the package, the optimum being a compromise between weight and stability considerations.

Figure 9:
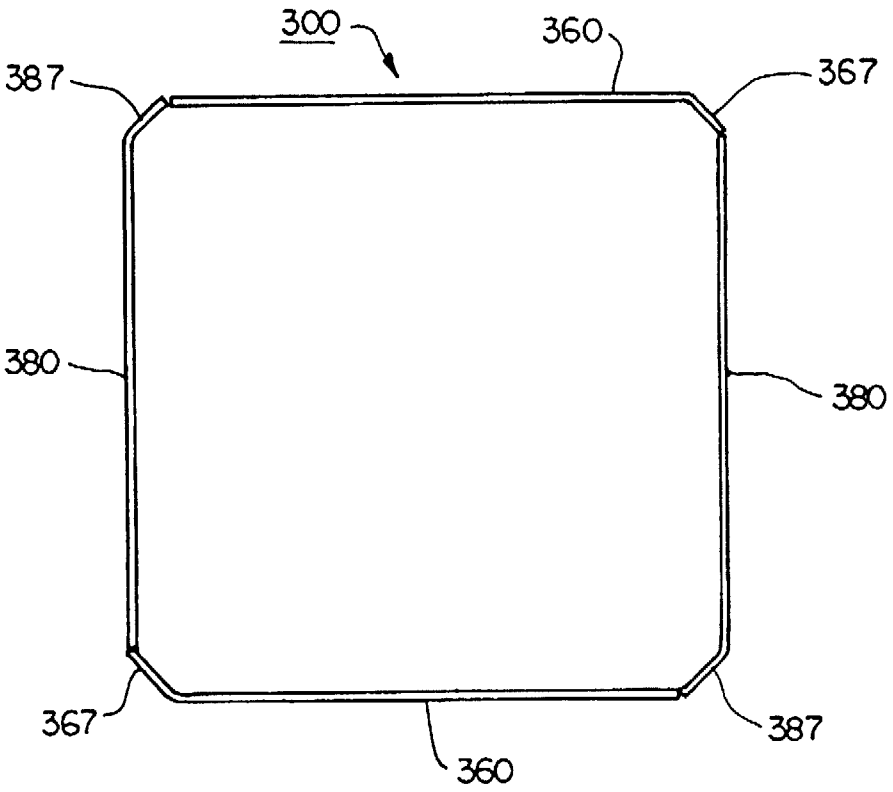
FIG. 9 is a top plan schematic view of a pallet system according to a further embodiment of the present invention.

As best seen in FIG. 9, a pallet system 300 according to a further embodiment is shown therein schematically in plan view from the top, the top panel being removed. Pallet system 300 includes end panels 360 and side panels 380. Each of end panels 360 includes a single shoulder 367. Each of side panels 380 includes a shoulder 387. Interlock means as described above for the first, second, and third embodiments may be provided for each panel 360, 380. If the pallet system configuration permits, end panels 360 and side panels 380 may be interchangeable.

It will be appreciated that pallet systems according to the present invention provide for a greater degree of reusability than prior art pallet systems. The end panels themselves may be used numerous times, having a life approximately equal to that of the top and intermediate panels. By contrast, corrugated cardboard corner posts have short life spans and are not highly recyclable.

Even though the preferred embodiments have been described in terms of end panels and side panels, it will be appreciated the end panels as described may be adapted to mount on the side of the pallet system rather than the ends.

The present invention may, of course, be carried out in other specific ways than those herein set forth without departing from the spirit and the essential characteristics of the invention. For example, the locator tabs may be formed as part of the top panel with cooperating recesses being formed in the end panels. As an alternative to hooks 112, 212 and prongs 72, snap means may be used as means for detachably securing the end panels to one or more of the base pallet, the intermediate panels, and the top panel. If snap means are provided, the end panels having one component of the snap means mounted thereon may be installed on the pallet system by transporting them horizontally such that the snap means components engage complementary snap means components mounted on the other members of the pallet system. Preferably, the snap means are easily and inexpensively replaceable. Suitable snap means include resilient fingers formed within the aforementioned recesses and adapted to receive and releasably secure the tabs. The present embodiments are, therefore, to be considered in all respects as illustrative and not restrictive and all changes coming within the meaning and equivalency range of the appended claims are intended to be embraced therein.

What is claimed is:

1. A pallet system for storing and transporting at least one package having a periphery and for use with a wrapping film, said pallet system comprising:

a) a base pallet having a first end and a second end;

b) first and second longitudinally extending grooves formed along said first and second ends, respectively, said grooves each including a bottom wall, an outer wall and an inner wall, said outer and inner walls extending upwardly on opposed sides of said respective bottom walls;

c) a top panel having a first end and a second end;

d) a first end panel extending between said first end of said base pallet and said first end of said top panel and forming an end wall extending therebetween, said first end panel having a lower edge, a left edge and a right edge;

e) wherein said lower edge of said first end panel is removably disposed in said first groove, said lower edge of said first end panel being adjacent said bottom wall and interposed between said inner and outer walls of said first groove;

f) a second end panel extending between said second end of said base pallet and said second end of said top panel and forming an end wall extending therebetween, said second end panel having a lower edge, a left edge and a right edge;

g) wherein said lower edge of said second end panel is removably disposed in said second groove, said lower edge of said second end panel adjacent said bottom wall and interposed between said inner and outer walls of said second groove; and h) wherein said left and right edges of respective end panels are configured such that, when said lower edges of said first and second end panels are disposed in said first and second grooves, respectively, the at least one package is disposed between said first and second end panels and the wrapping film is wrapped about said pallet system in tension, said left and right edges of respective end panels extend beyond the periphery of the at least one package, said left edges of said first and second end panels form a left side plane of film and said right edges of said first and second end panels form a right side plane of film, said left and right side planes of film being spaced from the at least one package.

2. The pallet system of claim 1 further including shoulders formed along each of said left edges and said right edges.

3. The pallet system of claim 1 further including at least one intermediate panel interposed between said base pallet and said top panel, and a locator projection extending from said at least one intermediate panel, and wherein each of said first end panel and said second end panel includes a cut-out adapted to receive said locator projection.

4. The pallet system of claim 3 wherein each of said cut-outs includes a recess arranged and configured to engage said locator projection so as to minimize movement of said end panel relative to said locator projection.

5. A pallet system for storing and transporting at least one package and for use with a wrapping film, said pallet system comprising:

a) a base pallet having an end edge;

b) a longitudinally extending groove formed along said end edge of said base pallet, said groove including a bottom wall, an outer wall and an inner wall, said outer and inner walls extending upwardly on opposed sides of said bottom wall;

c) a top panel overlying said base pallet;

d) an end panel adjacent said base pallet, said end panel having a lower edge;

e) wherein said lower edge of said end panel is removably disposed in said groove, said lower edge adjacent said bottom wall and interposed between said inner and outer walls; and f) wherein said end panel is arranged and configured such that, when said lower edge is disposed in said groove, the at least one package is disposed between said base pallet and said top panel and the wrapping film is placed around said pallet system, said end panel separates the wrapping film from at least a portion of the package.

6. A method of assembling pallet system, comprising the steps of:

a) placing a package on a base pallet;

b) mounting a pair of end panels on opposite ends of the base pallet, the end panels being arranged and configured so as to extend upwardly from the base pallet beyond the perimeter of the package, said step of mounting a pair of end panels including inserting lower edges forming a part of each end panel into a corresponding longitudinal groove extending along the opposed ends of the base pallet;

c) placing a top panel on the package and on upper edges of the end panels; and d) applying a tensile film wrap over the base pallet, the top pallet, and the end panels whereby the film wrap is maintained in spaced relation with the package on all sides.

7. A method of assembling a pallet system, comprising the steps of:

a) temporarily mounting a pair of end panels on opposite ends of a base pallet such that the panels each angle outwardly from the center of the base pallet, said step of mounting a pair of end panels including inserting lower edges forming a part of each end panel into a corresponding longitudinal groove extending along the opposed ends of the base pallet;

b) placing a package on the base pallet;

c) pivoting the end panels inwardly toward the center of the base pallet into a vertical position;

d) placing a top panel on upper edges the end panels and the package; and e) applying a tensile film wrap over the base pallet, the top pallet, and the end panels whereby the film wrap is maintained in spaced relation with the package on all sides.

* * * * *